United States Patent [19]

Tsuboi

[11] Patent Number: 4,995,797

[45] Date of Patent: Feb. 26, 1991

[54] ROTARY SCREW VACUUM PUMP WITH PRESSURE CONTROLLED VALVE FOR LUBRICATION/SEALING FLUID

[75] Inventor: Noboru Tsuboi, Kakogawa, Japan

[73] Assignee: Kabushiki Kaisha Kobe Seiko Sho, Kobe, Japan

[21] Appl. No.: 438,012

[22] Filed: Nov. 20, 1989

[30] Foreign Application Priority Data

Apr. 13, 1989 [JP] Japan ..... 1-95686

[51] Int. Cl.[5] ..... F04C 18/16; F04C 25/02; F04C 27/02

[52] U.S. Cl. ..... 418/84; 418/201.1; 418/DIG. 1; 418/87

[58] Field of Search ..... 418/84, 87, 97, 98, 418/99, 201 R, DIG. 1

[56] References Cited

U.S. PATENT DOCUMENTS 4,173,440 11/1979 Libis ..... 418/DIG. 1
4,525,129 6/1985 Berges et al. ..... 418/84
4,526,523 7/1985 Parker ..... 418/87
4,808,905 2/1989 Nishitani et al. ..... 418/99

FOREIGN PATENT DOCUMENTS 129677 2/1978 German Democratic Rep. ... 418/87

*Primary Examiner*—John J. Vrablik
*Assistant Examiner*—David L. Cavanaugh
*Attorney, Agent, or Firm*—Oblon, Spivak, McClelland, Maier & Neustadt

[57] ABSTRACT

A screw vacuum pump which includes a pair of screw rotors meshing each other with a small gap defined therebetween. A closing valve is provided in an oil circulation line leading from an oil stripper to a rotor chamber accommodating the screw rotors. A pressure switch for detecting a suction pressure is connected to the closing valve. When the suction pressure is lower than a predetermined value (i.e., at high level of vacuum), the closing valve is opened to supply the oil into the rotor chamber.

2 Claims, 2 Drawing Sheets

ROTARY SCREW VACUUM PUMP WITH PRESSURE CONTROLLED VALVE FOR LUBRICATION/SEALING FLUID

BACKGROUND OF THE INVENTION

The present invention relates to a screw vacuum pump provided with an oil stripper.

FIG. 3 shows a known oil screw compressor including a compressor body 21 rotatably accomodating a pair of male and female screw rotors meshing with each other, a discharge line 3 leading from a discharge port 2 of the compressor body 21, and an oil stripper 5 having a filter 4 therein and connected to the discharge line 3. The screw compressor further includes an oil return line 22 leading from the oil stripper 5 through an oil pump 13 to oil supply portions such as bearings, shaft sealing portions and rotor chamber in the compressor body 21. The oil thus returned from the oil stripper 5 to the compressor body 21 via the oil return line 22 is discharged again from the discharge port 2.

The oil supplied to the oil supply portions in the compressor body 21 for the purpose of lubrication, gas cooling, sealing, etc. is discharged together with a compressed gas to the discharge line 3. Then, the compressed gas is separated from the oil by the filter 4 in the oil stripper 5, and is fed from an upper portion of the oil stripper 5. On the other hand, the oil separated from the compressed gas is dripped to a bottom portion of the oil stripper 5, and is reserved in the oil stripper 5. Then, the oil is fed by an oil pump 13 to the oil supply portions in the compressor body 21, and is then introduced to the discharge port 2. Thus, the oil is circulated between the compressor body 21 and the oil stripper 5.

Assuming that an internal compression ratio $\pi$ i of the compressor body 21 is $\pi$ i=7, a discharge pressure is 7 kg/cm$^2$G in the case that a suction pressure is the atmospheric pressure. Accordingly, the discharge pressure is constant, and a gas flow rate at the filter 4 in the oil stripper 5 is therefore constant. Designing the size of the oil stripper 5 is dependent upon the constant gas flow rate.

Also known is an oil-free screw vacuum pump utilizing the above-mentioned compressor body 21 to be supplied with no oil into the rotor chamber in the compressor body 21. The oil-free screw vacuum pump is used in the fields (eg., semiconductor and food industries) wherein reverse flow of foreign matter to a vacuum suction side is not permitted. In this vacuum pump, a gap between the screw rotors and a gap between each screw rotor and a wall of the rotor chamber are not sealed by oil. Therefore, it is necessary to rotate the screw rotors at very high speeds, so as to reduce a quantity of gas leakage through the gaps.

In the other fields wherein reverse flow of foreign matter to the vacuum suction side is somewhat permitted, an oil screw vacuum pump similar to the compressor shown in FIG. 3 may be utilized. In the oil screw vacuum pump, the gap between the screw rotors and the gap between each screw rotor and the wall of the rotor chamber are sealed by the oil supplied into the rotor chamber. Therefore, the rotational speed of the screw rotor needs not to be made so high as in the above-mentioned oil-free type.

FIG. 4 shows such an oil screw vacuum pump having the same construction as the compressor shown in FIG. 3. Referring to FIG. 4, air is sucked from a vacuum tank 11 by a vacuum pump body 21*a*, and is compressed in the pump body 21*a*. Then, a compressed gas is discharged through the oil stripper 5 to the atmosphere.

Referring to FIG. 5, a suction pressure of the vacuum pump shown in FIG. 4 starts changing from 760 Torr (atmospheric pressure) to a predetermined partial vacuum which depends on the application of the vacuum tank 11.

Assuming that a volumetric flow of air to be sucked into a suction port of the screw vacuum pump is represented by $V_1$(m$^3$/hr); a volumetric flow of air to be discharged from the discharge port 2 is represented by $V_2$ (m$^3$/hr); a suction pressure is represented by $P_1$ (Torr); and a discharge pressure is represented by $P_2$ (Torr), the volumetric flow $V_1$ is defined according to the screw vacuum pump, and the following equation holds.

$$V_2 = V_1 \cdot (P_1/P_2)$$

At starting of the vacuum pump, the suction pressure $P_1$ is 760 Torr which starts dropping, and the discharge pressure $P_2$ is also 760 Torr which is constant. Therefore, the volumetric flow $V_2$ at a point shown in FIG. 5 is expressed as follows:

$$V_2 = V_1 \cdot (760/760)$$

When the suction pressures are reduced to 100 Torr at a point b and 10 Torr at a point c as shown in FIG. 5, the volumetric flows $V_2$ at the discharge port 2 are as follows:

$$V_2 = V_1 \cdot (100/760)$$

$$V_2 = V_1 \cdot (10/760)$$

In this manner, the volumetric flow at the discharge port in the case of a vacuum pump is changed widely according to the suction pressure.

As previously mentioned, the size of the oil stripper 5 is dependent upon a gas flow rate on the discharge side. Accordingly, in the case that the suction pressure at the point c shown in FIG. 5 is used when designing the oil stripper 5, an air flow rate on the discharge side at the point a is 76 times that at the point c, and 7.6 times that at the point b. As a result, the oil is widely scatterd to the atmosphere side at points a and b. In contrast, if the suction pressure at the point a is used when designing the oil stripper 5, the size of the oil stripper 5 becomes very large.

In the case of the compressor, since a gas flow rate on the discharge side is substantially constant, proper selection of the oil stripper is easy. However, in a case of the vacuum pump, the gas flow rate on the discharge side changes up to 50 times or 100 times. Because of such a large change in gas flow rate, proper selection of the oil stripper size is difficult in both the case of small flow rate and large flow rate.

SUMMARY OF THE INVENTION

Accordingly, it is an object of the present invention to provide a screw vacuum pump which improves exhaust efficiency and ensure proper selection of the oil stripper.

According to the present invention, there is provided a screw vacuum pump comprising a pump body having a pair of male and female screw rotors meshing each other with a small gap defined therebetween, one of said screw rotors being driven, a pair of rotor shafts for mounting said screw rotors, a pair of synchronizer gears mounted on said rotor shafts and meshing each other to synnchronously rotate both said screw rotors, a rotor chamber for accommodating said screw rotors, and a plurality of lubricating portions including bearing portions for lubricating said rotor shafts; an oil stripper for separating a compressed gas from an oil; a discharge gas line leading from a discharge port of said pump body to said oil stripper; an oil circulation line leading from said oil stripper through said lubricating portions and said rotor chamber in said pump body to said discharge port of said pump body, said oil circulation line being branched to a first line leading to said lubricating portions and a second line leading to said rotor chamber; a closing valve provided in said second line; and a pressure switch for detecting a suction pressure of said pump body and opening said closing valve when the suction pressure detected by said pressure switch becomes a predetermined value or less.

With this construction, rotation of one of the screw rotors which do not directly constant each other is transmitted to the other screw rotor through the synchronizer gears mounted on the rotor shafts. Accordingly, when the suction pressure is high or normal (i.e.) near atmospheric, the oil need not be supplied to the rotor chamber for the rotation of the screw rotors. On the other hand, only when the suction pressure is low (i.e., a high vacuum) to cause a problem of gas leakage through the gap between both the screw rotors and the gap between each screw rotor and the wall of the rotor chamber, the oil is supplied to the rotor chamber by opening the closing valve provided in the oil circulation line leading to the rotor chamber, so that a change in gas flow rate on the discharge side may be reduced.

That is, only when the suction pressure is lower than the predetermined value, the oil is supplied to the rotor chamber, thereby reducing the gas leakage through the gaps and improving the exhaust efficiency of the pump.

Further, the size of the oil stripper can be properly selected according to a narrow employable range of gas flow rate, thereby eliminating release of soot to the atmosphere in case of an excessively small size of the oil stripper and a problem in case of an excessively large size thereof.

Other objects and features of the invention will be more fully understood from the following detailed description and appended claims when taken with the accompanying drawings.

DETAILED DESCRIPTION OF THE PREFERRED EMBODIMENTS

There will now be described a preferred embodiment of the present invention with reference to the drawings.

Figure 1:
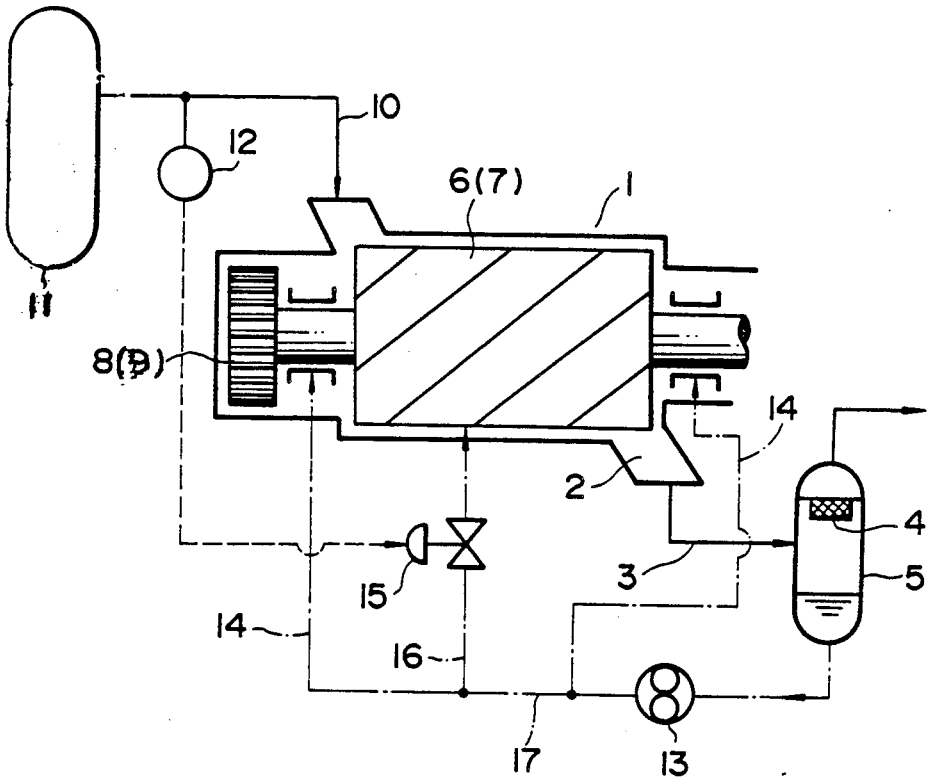
FIG. 1 is a schematic illustration of a preferred embodiment of the screw vacuum pump according to the present invention.
Figure 2:
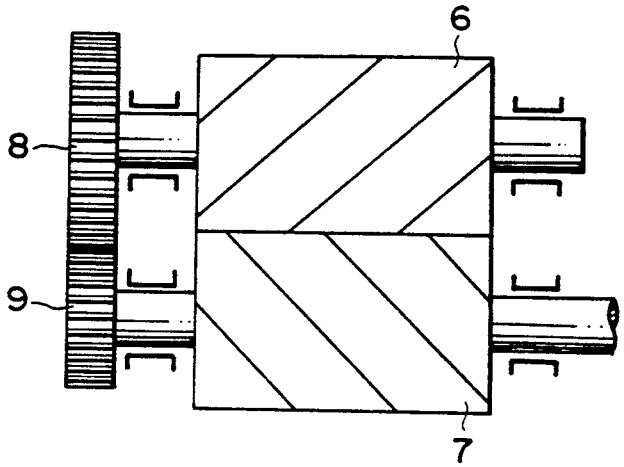
FIG. 2 is a plan view of the screw rotors and the synchronizer gears shown in FIG. 1.
Figure 3:
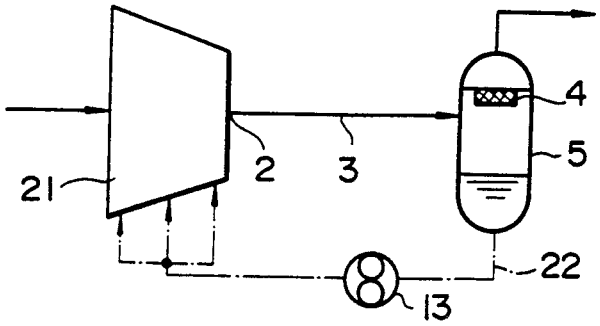
FIG. 3 PRIOR ART
FIG. 3 is a schematic illustration of the conventional oil screw compressor.
Figure 4:
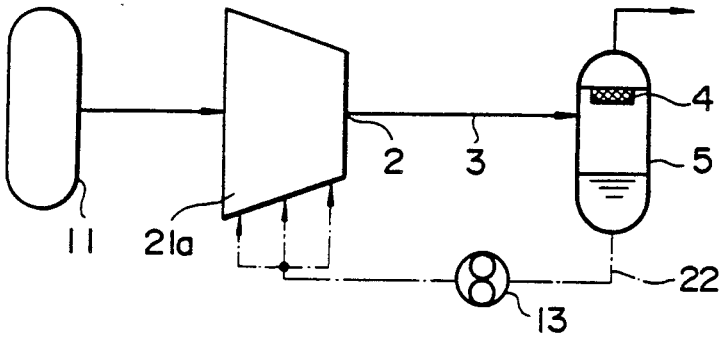
FIG. 4 PRIOR ART
FIG. 4 is a schematic illustration of a screw vacuum pump using the screw compressor shown in FIG. 3.
Figure 5:
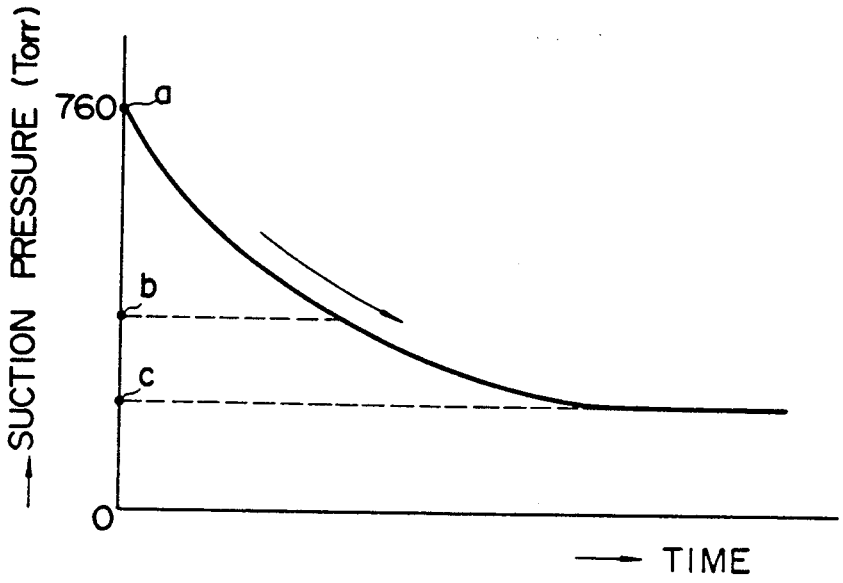
FIG. 5 is a graph showing the relationship between a suction pressure and a time elapsed.

Referring to FIGS. 1 and 2 wherein the same reference numerals as in FIGS. 3 and 4 denote the same parts, the discharge port 2 of a pump body 1 is connected through the discharge line 3 to the oil stripper 5 having the filter 4 therein. There is provided in the pump body 1 a pair of female and male screw rotors 6 and 7 meshing with each other with a small gap defined therebetween. That is, both the rotors 6 and 7 are maintained not to directly contact with each other. A pair of synchronizer gears 8 and 9 meshing with each other are mounted on respective rotor shafts of the screw rotors 6 and 7. The male screw rotor 7 is driven to rotate the synchronizer gears 8 and 9, thereby to effect the synchronous rotation of both the screw rotors 6 and 7.

A suction line 10 is connected between the pump body 1 and the vacuum tank 11, and a pressure switch 12 is provided in the suction line 10 for detecting a suction pressure.

An oil circulation line 17 is connected between the bottom of the oil stripper 5 and the pump body 1. An oil pump 13 is provided in the oil circulation line 17. Downstream of the oil pump 13 the oil circulation line 17 is branched to first lines 14 communicated with lubricating portions including bearing portions, shaft sealing portions and synchronizer gear portions in the pump body 1 and a second line 16 communicated with a rotor chamber in the pump body 1. A solenoid valve 15 is provided in the second line 16. The oil supplied to the lubricating portions and the rotor chamber is discharged again from the discharge port 2 to the oil stripper 5.

The pressure switch 12 provided in the suction line 10 is connected to the solenoid valve 15 provided in the second line 16 branched from the oil circulation line 17 and leading to the rotor chamber. When the suction pressure detected by the pressure switch 12 becomes equal to or less than a predetermined value, the solenoid valve (i.e., high level of vacuum) 15 is opened to allow the oil to be supplied into the rotor chamber, thereby sealing the gap between the rotors 6 and 7 and the gap between each rotor and the wall of the rotor chamber.

That is, only when the suction pressure is low, the oil is supplied to the rotor chamber. The air sucked from the vacuum tank 11 by the pump body 1 is compressed to be discharged with the oil from the discharge port 2. Then, the oil is separated from the compressed air in the oil stripper 5, and is reused to be supplied to the pump body 1.

On the other hand, when the suction pressure exceeds the predetermined valve, the solenoid valve (i.e., rear atmospheric pressure) 15 is closed to cut the supply of oil to the rotor chamber. Accordingly, the air sucked from the vacuum tank 11 is compressed in the pump body 1 and is then discharged from the discharge port 2 without oil in the rotor chamber in the same manner as in the oil-free screw vacuum pump. Then, only the compressed air passes through the oil stripper 5.

Accordingly, the oil stripper 5 may be so designed as to be able to separate the oil from the compressed air in a narrow pressure region corresponding to a low structure pressure, that is, in a narrow gas flow rate region.

As to the oil supply portions in the rotor chamber, the oil may be supplied to the meshing portion between both the rotors, either of the rotors, or different portions of both the rotors.

Although the above preferred embodiment includes the oil pump, it may be eliminated according to the present invention.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A screw vacuum pump comprising:

a pump body having a pair of male and female screw rotors meshing with each other with a small gap defined therebetween, one of said screw rotors being driven, a pair of rotor shafts mounting said screw rotors, a pair of synchronizer gears mounted on said rotor shafts and meshing with each other to synchronously rotate both said screw rotors.

a rotor chamber accommodating said screw rotors, a plurality of lubricating portions including bearing portions for lubricating said rotor shafts an oil stripper for separating a compressed gas from an oil, a discharge gas line leading from discharge port of said pump to said oil stripper, an oil circulation line leading from said oil stripper to said lubricating portions and said rotor chamber in said pump body, said oil circulation line being branched to a first line leading to said lubricating portions and a second line leading to said rotor chamber, a closing valve provided in said second line, and a pressure switch comprising means for detecting a suction pressure of said pump body, wherein said closing valve is responsive to the pressure detected by said pressure switch for opening said closing valve when the suction pressure detected by said pressure switch falls below a predetermined value and reaches a high level of vacuum.

2. The screw pump of claim 1 wherein said oil stripper has a size optimal for oil stripping when the suction pressure reaches a high level of vacuum.

* * * * *